US007487619B2

(12) United States Patent
Glenn

(10) Patent No.: US 7,487,619 B2
(45) Date of Patent: Feb. 10, 2009

(54) WATER TANK

(76) Inventor: Roy D. Glenn, 407 W. Oak St., Suite 200, Laurel, MS (US) 39441

( * ) Notice: Subject to any disclaimer, the term of this patent is extended or adjusted under 35 U.S.C. 154(b) by 193 days.

(21) Appl. No.: 11/519,047

(22) Filed: Sep. 12, 2006

(65) Prior Publication Data

US 2008/0060287 A1 Mar. 13, 2008

(51) Int. Cl.
*E04H 7/00* (2006.01)
*B65D 90/02* (2006.01)
*B65D 1/42* (2006.01)

(52) U.S. Cl. ..... 52/194; 52/192; 52/193; 52/197; 220/565; 220/566; 220/567; 220/646

(58) Field of Classification Search ..... 52/192, 52/193, 194, 197; 220/566, 567, 565, 646, 220/650, 668
See application file for complete search history.

(56) References Cited

U.S. PATENT DOCUMENTS

| | | | | |
|---|---|---|---|---|
| 1,947,515 | A | 2/1934 | Blackburn | 220/567 |
| D111,257 | S | 9/1938 | Horton | D23/205 |
| D111,258 | S | 9/1938 | Horton | D23/205 |
| D111,259 | S | 9/1938 | Horton | D23/205 |
| D114,540 | S | 5/1939 | Horton | D23/205 |
| D122,600 | S | 9/1940 | Horton | D23/204 |
| 2,346,129 | A | 4/1944 | De Vore | 220/567 |
| 2,657,819 | A | 11/1953 | Blackburn | 220/567 |
| 2,855,121 | A | 10/1958 | Sturm | 220/566 |
| D197,264 | S | 12/1963 | Anderson | D23/205 |
| D197,265 | S | 12/1963 | Anderson | D23/205 |
| 3,363,795 | A | 1/1968 | Stuart, III | 220/567 |
| 4,327,531 | A | 5/1982 | Cazaly | 52/73 |
| 4,486,989 | A | 12/1984 | DesRochers | 52/194 |
| 4,660,336 | A * | 4/1987 | Cazaly et al. | 52/192 |
| 6,318,034 | B1 | 11/2001 | Zavitz | 52/194 |

OTHER PUBLICATIONS

Joe Diffie—John Deere Green Lyrics. Apr. 14, 2005. Cowboy Lyrics. May 13, 2008. <http://web.archive.org/web/20050414194427/http://www.cowboylyrics.com/lyrics/diffie-joe/john-deere-green-4048.html>.*

* cited by examiner

*Primary Examiner*—Basil Katcheves
*Assistant Examiner*—Branon C Painter
(74) *Attorney, Agent, or Firm*—Jacobson Holman PLLC

(57) ABSTRACT

A blending of geometrical shapes combine the best features of a pipe tank (standpipe) and a common multi-legged elevated tank. The bowl of an elevated tank has been designed as the top section of a standpipe or tube tank. This type design provides the near constant pressure and volume that a true elevated tank provides and a large volume of water for emergency purposes.

9 Claims, 7 Drawing Sheets

PRESSURE/VOLUME DEGRADATION CURVES
500 GPM DEMAND

WATER TANK

FIELD OF THE INVENTION

The present invention relates to a water tank having the advantageous features of increased quantity of water supply and increased duration of dispensing water without increasing overall height of the water tank.

BACKGROUND OF THE INVENTION

A water tower or elevated water tank is a very large tank constructed for the purpose of holding a supply of water at a height sufficient to pressurize a water supply system. A typical water tower is constructed of either steel, reinforced or prestressed concrete, or brick, and includes a bowl of either spherical or cylindrical shape, is approximately 50 feet (16 meters) in diameter and has a maximum height of approximately 120 feet.

The users of the water supply (a town, factory, or just a building) need to have water pressure to maintain the safety of the water supply. The height of the tower provides the hydrostatic pressure for the water supply system and it may be supplemented with a pump. The volume of the reservoir and diameter of the piping provide and sustain flow rate.

When the water level in a true elevated tank drops to the bottom of the elevated bowl, the tank is essentially empty. The wet center riser pipe, which is no more than 36 inches in diameter, does not qualify as a water storage device. Consequently, the water pressure provided by the true elevated tank drops quickly to zero (0) immediately after the water in the elevated bowl falls to the bottom of the bowl.

SUMMARY OF THE INVENTION

The present invention is a radical departure from current potable water storage tank designs. It combines the properties of a true multi-legged elevated tank and a standpipe or true constant diameter tube tank.

The tank of the present invention is a blending of geometrical shapes that combine the best features of a pipe tank (standpipe) and a common multi-legged elevated tank. The bowl of an elevated tank has been designed as the top section of a standpipe or tube tank. This type design provides the near constant pressure and volume that a true elevated tank provides and a large volume of water for emergency purposes.

This new design incorporates the reserve capacity of a constant diameter standpipe and the larger capacity of an elevated tank that stores all water at a high elevation. The geometry of this design can take may different forms. It includes a small diameter cylinder mated to a large diameter cylinder utilizing a truncated conical section, and as a cylinder mated to a large elliptical bowl or a spherical bowl. A design peculiarity of this tank is that the tank geometry is defined by an aspect ratio (the diameter of the lower supporting tube divided by the diameter of the upper larger tube or ellipse or sphere storage container).

This feature, the aspect ratio, gives this design an almost unlimited degree of flexibility. Since the large upper portion of this tank will provide the day-to-day working pressure and volume, similar to an elevated tank, while the constant diameter supporting standpipe section provides the volume and pressure for emergency situations. The ratio of the smaller pipe diameter to the upper large bowl diameter can be used to provide the ideal amount of water stored at altitude and the correct amount of stored water supplies for emergency applications.

Access into this tank is restricted by a unique pilaster design that not only adds a distinctive look but also protects the tank from intruders and vandalism as well as maintains the integrity of a water supply. Enclosing a ladder inside a pilaster and designing a door into the pilaster that can be made secure provides a high degree of security. This design requires an extra-vented access hatch in the tank top that allows fresh air to draft from the base of the pilaster that encloses the ladder.

Access through the tank bowl is provided by a large diameter tube that exits above the high water level and terminates at a watertight expansion joint just a few inches below the breather/hatch combination that opens to the exterior of the tank top. A second breather/hatch combination provides entry into the bowl and supporting tubular tank interior.

The tank of the present invention provides a large amount of storage in the tube tank beneath the elevated bowl, and continues to provide water for a long period of time after the elevated bowl has become empty. As a result of the large amount of stored water below the bowl bottom of the tank, this tank can still provide emergency water for many hours.

The flexibility of the design of the present invention is demonstrated by the following examples.

- The volume of the tube tank is compared to the volume of the bowl at an altitude by the ratio of $V_{BOWL}/V_{PIPE}$. The ratio ($V_{BOWL}/V_{PIPE}$) can be adjusted to fit a customer's requirements. Typically a height of the bowl: the height of the tube is approximately 1:3, whereas a width of the bowl: a width of the tube is approximately 2:1.
- Access into the tank is unique to this design. A door constructed into the side of one of the pilasters encloses the access ladder which is extended vertically up the side of the standpipe, through the bowl section and exits at the top of the bowl. Another access, which opens into the interior of the bowl, is necessary not only to provide access into the tank but also supplies atmospheric pressure as the water level increases or decreases.
- This is a unique design in that it combines the best feature of a pure elevated tank where all water is stored at a pre-determined safe altitude and a standpipe which contains a large volume of water where 70%-80% is stored below a safe altitude, but can be utilized in emergency conditions.

Accordingly, it is an object of the present invention to provide a water tank having an upper portion for storing water and a lower portion for storing water, with the lower portion supporting the upper portion.

It is another object of the present invention to provide a water tank having an upper portion for storing water and a lower portion for storing water, with the lower portion supporting the upper portion where the lower portion is cylindrical in shape and the upper portion is in the shape of one of a truncated conical section, an elliptical bowl and a spherical bowl.

It is still yet another object of the present invention to provide a water tank having an upper portion for storing water and a lower portion for storing water, with the lower portion supporting the upper portion where the lower portion is cylindrical in shape and the upper portion is in the shape of one of a truncated conical section, an elliptical bowl and a spherical bowl with a ratio of a height of the upper portion to a height of the lower portion is approximately 1:3 and a ratio of the width of the upper portion to a width of the lower portion is approximately 2:1.

It is still yet another object of the present invention to provide a water tank having an upper portion for storing water and a lower portion for storing water, with the lower portion supporting the upper portion where the lower portion is cylindrical in shape and the upper portion is in the shape of one of a truncated conical section, an elliptical bowl and a spherical bowl with a ratio of a height of the upper portion to a height of the lower portion is approximately 1:3 and a ratio of the width of the upper portion to a width of the lower portion is approximately 2:1 and with a pilaster mounted on the exterior of the lower portion and extending into and through the upper portion to provide a ladder access to the top of the upper portion where a vented man-hole cover is located.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the Water Tank disclosed herein, and are for illustrative purposes only. Other embodiments that are substantially similar can use other components that have a different appearance.

DETAILED DESCRIPTION OF THE PREFERRED EMBODIMENTS

Figure 1:
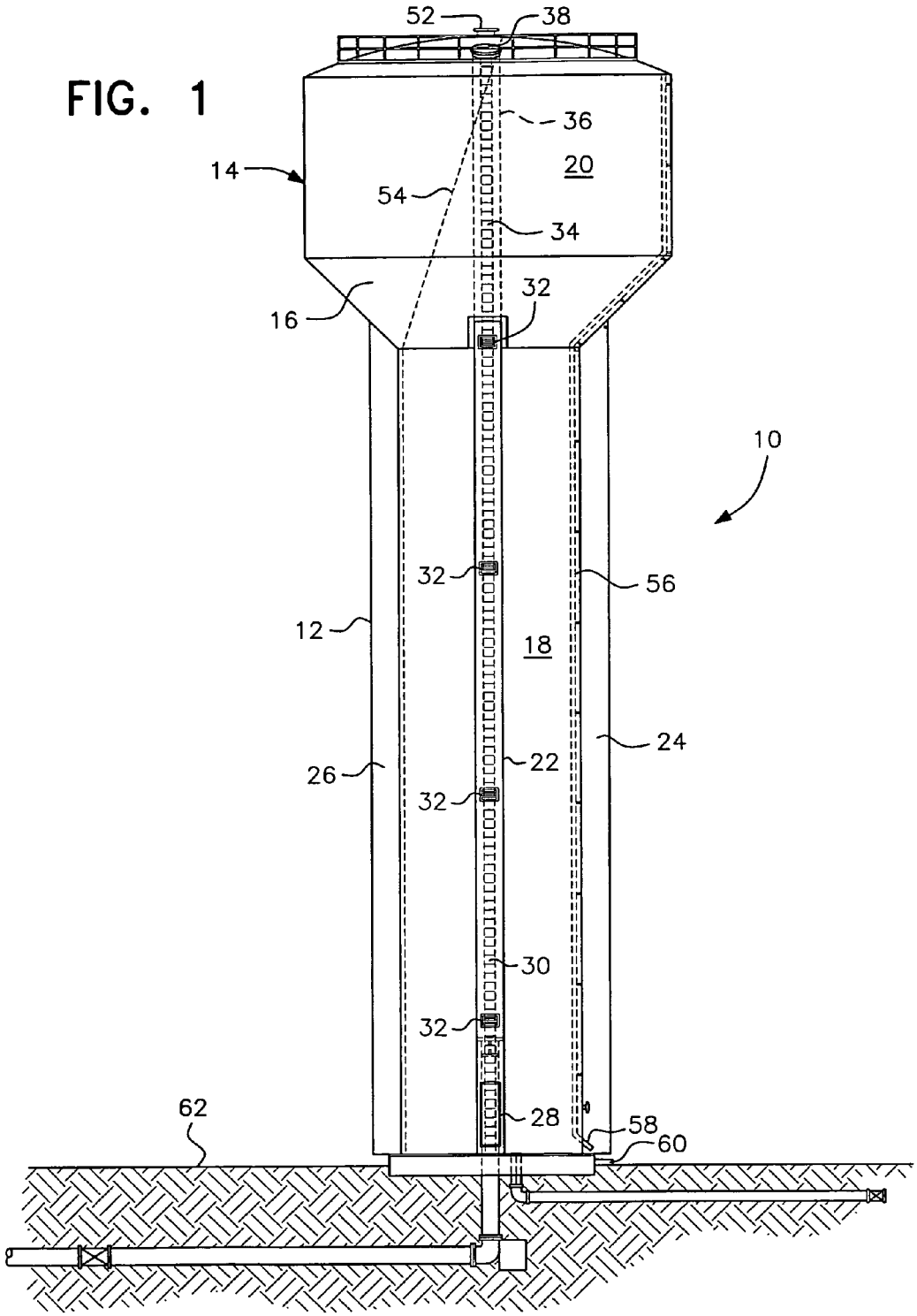
FIG. 1 is an elevational view of a water tank and a sectional view of the foundation for the tank embodying the principles of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
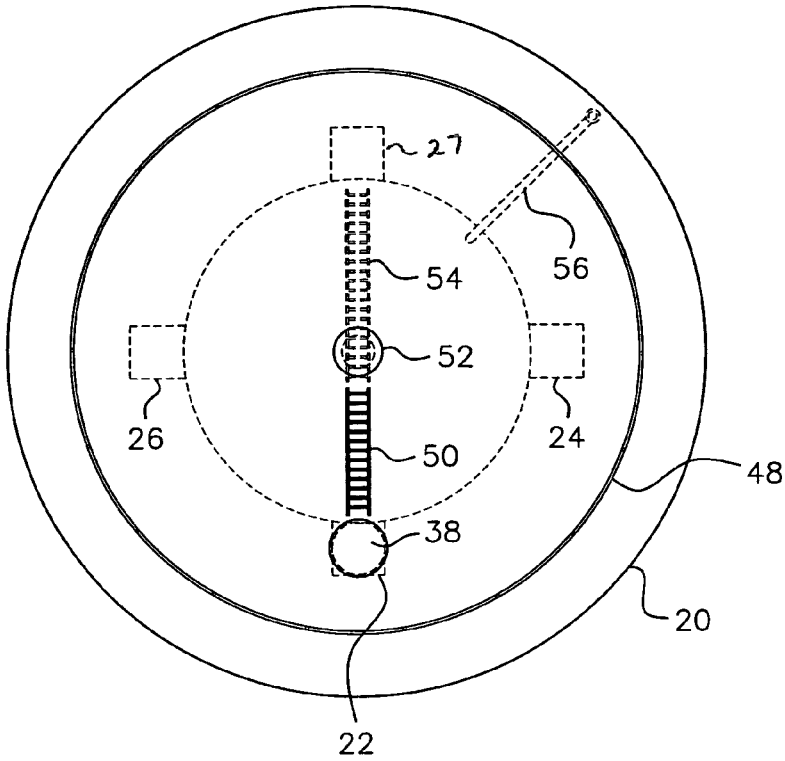
FIG. 2 is a top view of the water tank in FIG. 1.
Figure 3:
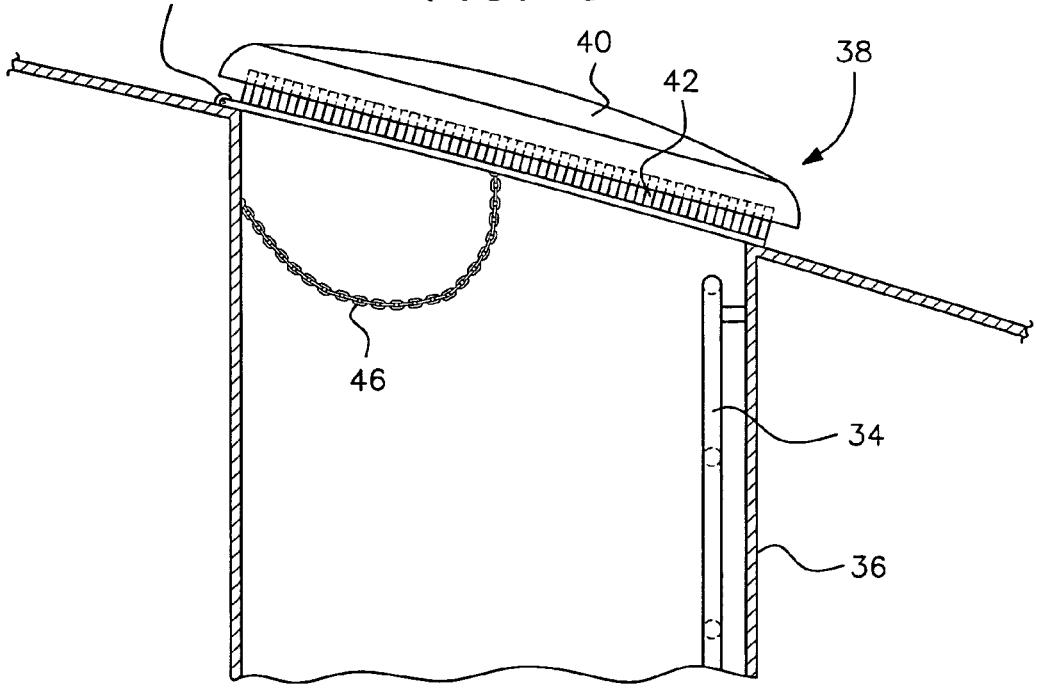
FIG. 3 is an enlarged view of a roof man-hole detail from the roof of the water tank in FIG. 1.

With reference to the drawings, in general, and FIGS. 1 through 3, in particular, a water tank embodying the teachings of the present invention is generally designated as 10. With reference to its orientation in FIG. 1, the water tank includes a tube tank portion 12 and a bowl tank portion 14. The tube tank portion is ninety feet high to the base of the conical portion 16 of the bowl tank portion 14. The diameter of the tubular water containing portion 18 of the tube tank portion 12 is twenty feet.

The conical shaped portion 16 has a height from the tube tank portion 12 to the cylindrical portion 20 of the bowl tank portion 14 of ten feet. The diameter of the conical portion 16 increases from twenty feet at cylindrical portion 18 to forty feet at cylindrical portion 20. The diameter of the cylindrical portion 20 is forty feet, having a height of twenty feet. The overall height of the water tank at the top of the cylindrical portion 18, which is also the high water level, to the top of the foundation is one hundred twenty feet.

Spaced about the circumference of the tubular water containing portion 18, are a plurality of pilasters 22, 24, 26 and a rear pilaster 27 (shown in FIG. 2) having a width of three feet. Pilaster 22 includes a pedestal access door 28 having a lock. Inside the pilaster 22 is a ladder 30 for access by an individual. Spaced along the height of the ladder 30 are louvered vents 32 with insect screening. At the bowl tank portion 14, ladder 30 continues as ladder 34 within a tube 36 located within the bowl tank portion 14. The ladder 34 terminates at roof man-hole 38.

As shown in more detail in FIG. 3, the roof man-hole 38 includes a hatch cover 40 and a continuous vent 42 hinged at hinge 44 and having a retainer strap 46. Access to the roof is thereby achieved within an exterior railing 48 and an exterior ladder 50 leading to air vent 52.

Located within bowl tank portion 14 is an interior tank ladder 54 rotated in FIG. 1 for clarity.

Extending within the tube tank portion 12 and bowl tank portion 14 is an overflow pipe 56, six inches in diameter, rotated in bowl tank portion 14 for clarity. The overflow pipe terminates at end 58 in a splash block 60 at an upper surface of the foundation 62.

Figure 4:
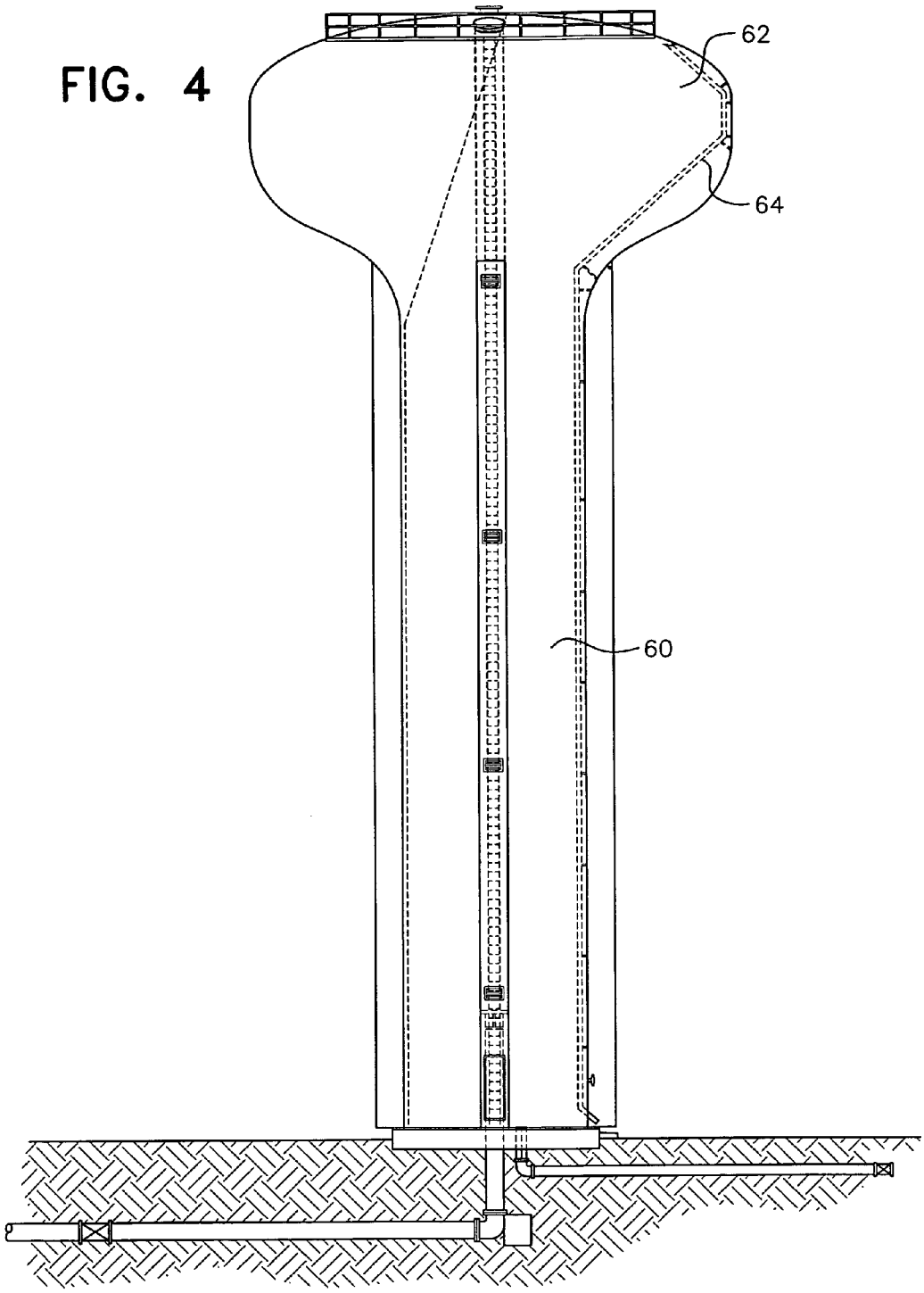
FIG. 4 is an elevational view of an alternate embodiment of the water tank embodying the principles of the present invention.
Figure 5:
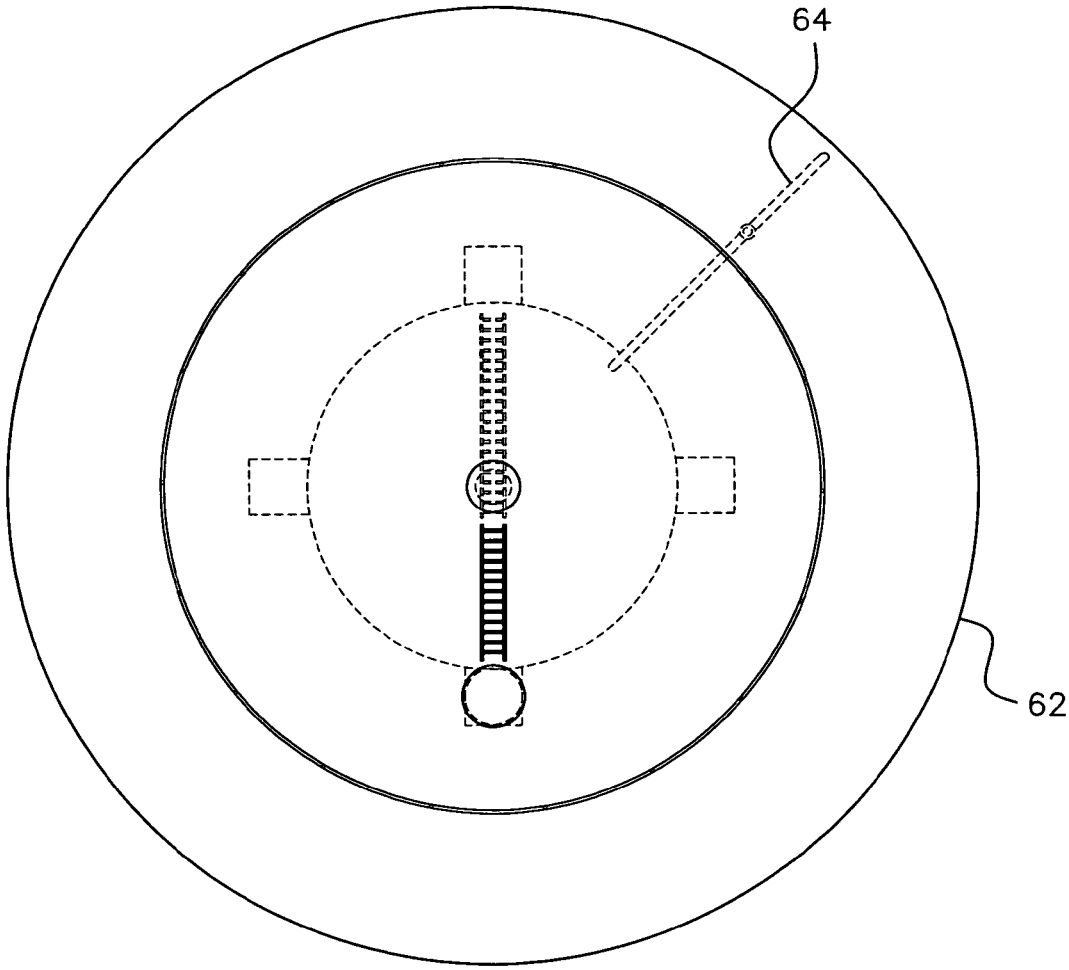
FIG. 5 is a top view of the water tank shown in FIG. 4.

With reference to FIGS. 4 and 5, the tube tank portion 60 has parallel side walls extending from the foundation for a height of ninety feet. The side walls then diverge into an elliptical tube portion 62 having an overall height of thirty feet for a high water elevation level of one hundred twenty feet from the foundation. Similar structure is found in the embodiment of FIGS. 4 and 5 to that of FIGS. 1 through 3 including a six inch diameter overflow pipe 64 terminating adjacent to the high water level in the tank.

Figure 6:
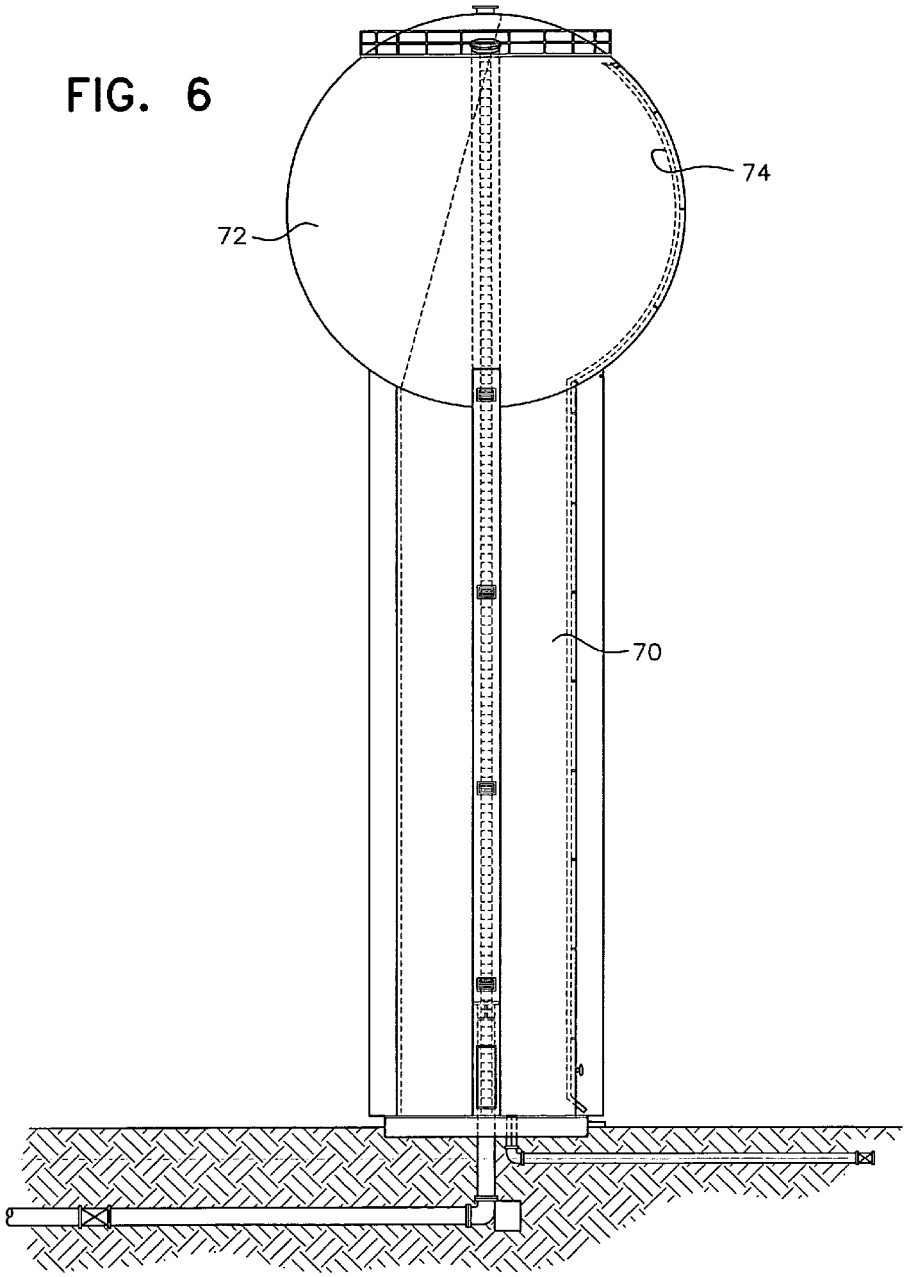
FIG. 6 is an elevational view of an alternate embodiment of the water tank embodying the principles of the present invention.
Figure 7:
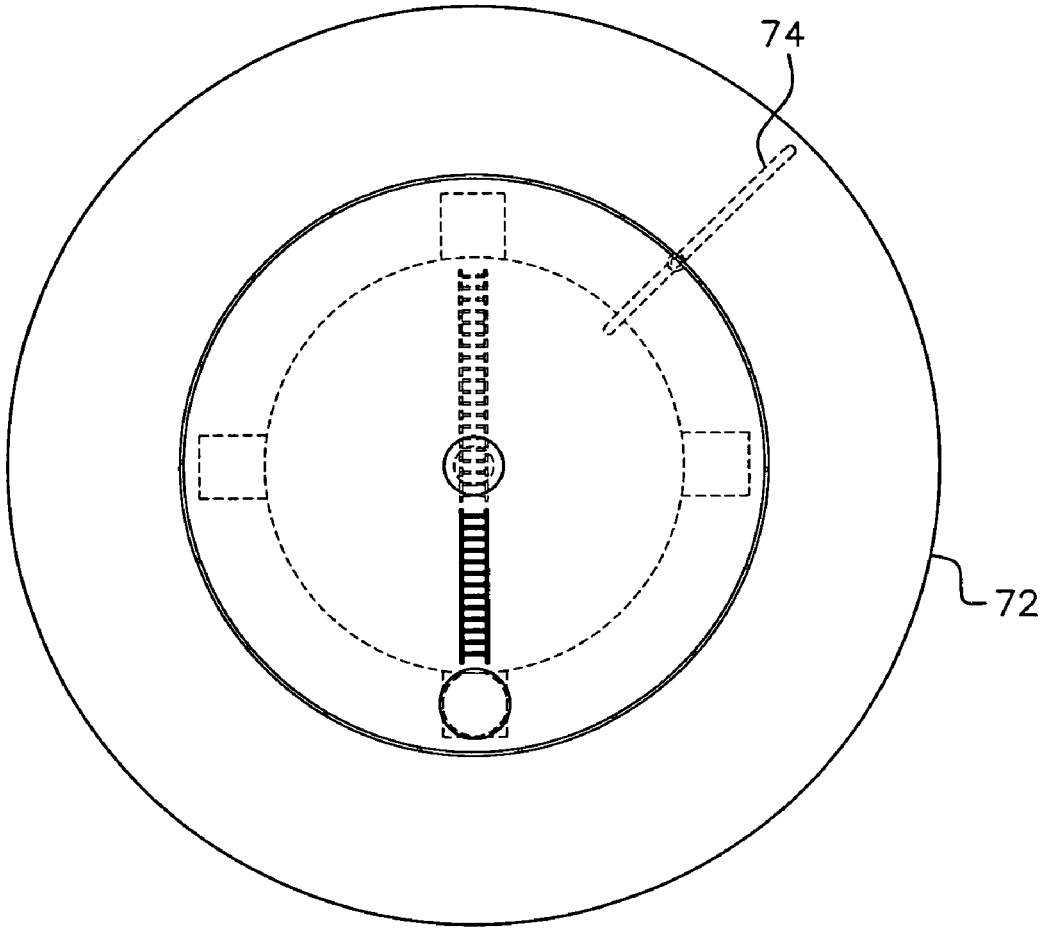
FIG. 7 is a top view of the water tank shown in FIG. 6.

In FIGS. 6 and 7, a tube tank portion 70 extends until reaching a spherical bowl portion 72 for a combined height of one hundred twenty feet from the foundation tube to the high water elevation. The spherical bowl portion has a diameter of forty-four feet. Similar to FIGS. 1 and 4, a six inch diameter overflow pipe 74 extends to the high water level elevation of the tank.

Figure 8:
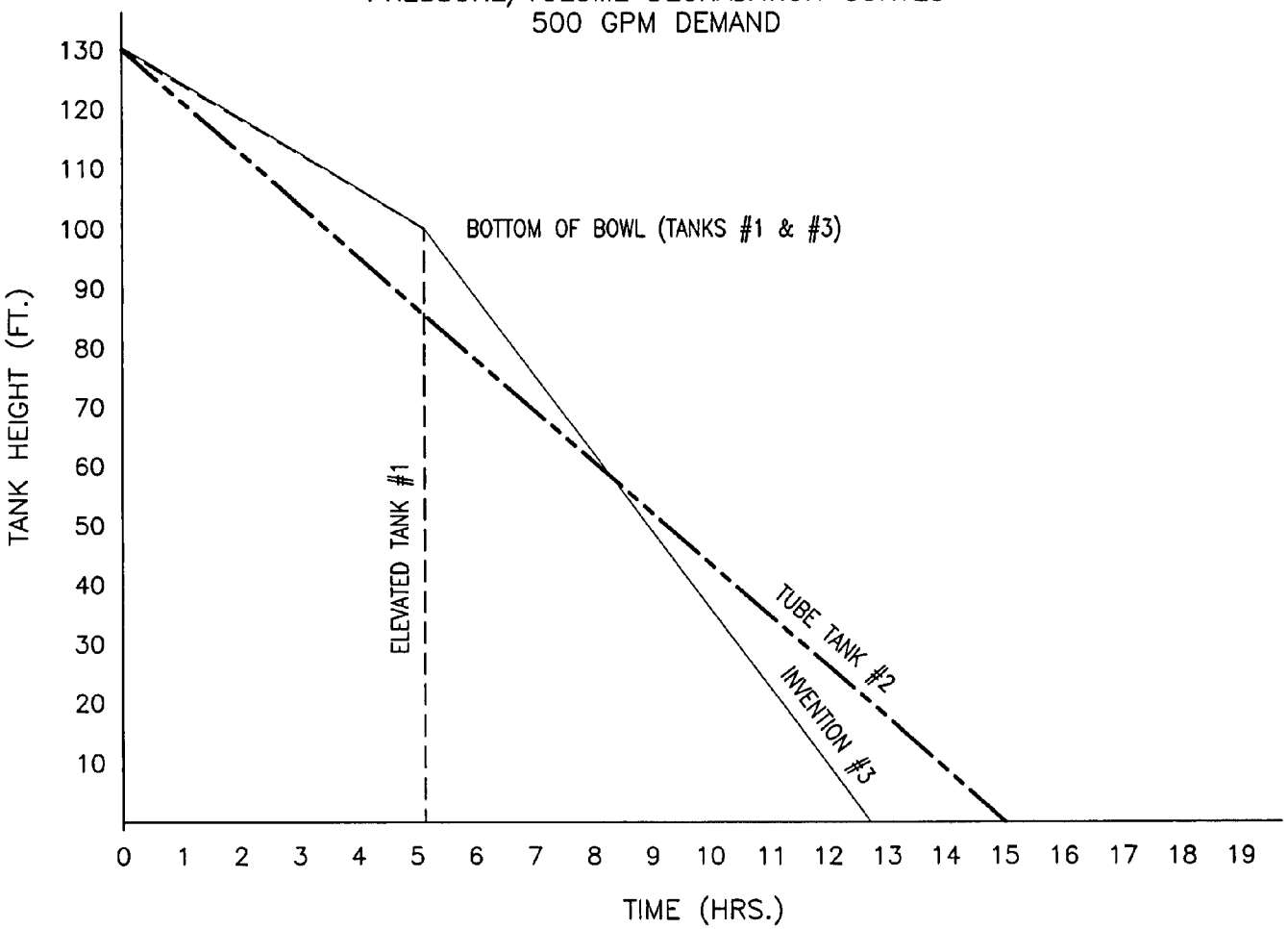
FIG. 8 graphically illustrates the advantages of the water tank of the present invention as compared to an elevated water tank and to a tube water tank.

In FIG. 8, the volume per foot curve of the tank design of the present invention is compared to existing tank designs and as can be seen from these plots, the present design is by far the most efficient.

The plots show how the volume of the tank design differs from the standard elevated tank design and the standard tube tank design. The curves are based on stored volume of 150,000 gallons, overflow height of 130 feet and water usage of 500 gpm. The standard tube tank curve is plotted with the assumption that the upper ⅓ of the tank height is used as elevated storage. Consequently, the tank diameter had to be 66.39 feet which gives this tank a total capacity of 450,000 gallons (the top ⅓ being elevated storage).

A description of the plots is as follows:

1. Elevated tank (#1)

This tank performs well until the water reaches the bottom of the tank bowl, however, since the small diameter center riser that supplies the bowl has very little volume, the elevated tank is completely empty after 5 hours, 4.7 minutes.

2. Tube Tank (#2)

This tank had to be quite large in order to provide 150,000 gallons of volume between 100'-130' elevation. The overall volume of this tank had to be 450,000 gallons in order to match the elevated tank in volume at the design altitude. The plot for this tank shows that the volume falls to the 100-foot mark in 3 hours 24 minutes compared to the true elevated tank time of 5 hours (#1). The remainder of the volume can only be effectively used as emergency supply.

3. The Tank of the Present Invention (#3)

This design is identical to the elevated tank from 100' to 130' that gives both tanks excellent storage and pressure characteristics. From 100' to 0' the design of the present invention out-performs the elevated tank with a total duration of 12.83 hours compared to 5.04 hours duration in the elevated tank.

The comparison of the tank of the present invention to the tube tank shows, similar to the elevated tank, the volume between 100'-130' lasts 1.6 hours longer than the tube tank. The overall duration of the inventive tank is only slightly less (12.83 hours) than the tube tank (15 hours). The tube diameter of the tank of the present invention is only 20' compared to 66.34' of the true tube tank (#2).

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A water tank comprising:

an upper tank portion for storing water, a lower water containing tank portion for storing water and supporting the upper tank portion, said lower water containing tank portion being cylindrical in shape, a ratio of a height of the upper tank portion to a height of the lower water containing tank portion being approximately 1:3, a ratio of a width of the upper tank portion to a width of the lower water containing tank portion being approximately 2:1, and a pilaster directly mounted along the height of the exterior surface of the lower water containing tank portion, said pilaster including a ladder passing therein and extending through an opening in an interior of the upper tank portion to provide access to a roof of said upper tank portion simultaneously with water being contained in said lower water containing tank portion.

2. The water tank as claimed in claim 1, wherein the upper tank portion is in a shape of one of a truncated conical section, an elliptical bowl and a spherical bowl.

3. The water tank as claimed in claim 1, wherein the pilaster includes a ladder.

4. The water tank as claimed in claim 3, wherein the pilaster extends to an interior of the upper tank portion.

5. The water tank as claimed in claim 4, wherein an upper opening of the pilaster is located at an outer surface of the upper tank portion.

6. The water tank as claimed in claim 5, wherein said upper opening includes a manhole with an air vent.

7. The water tank as claimed in claim 6, wherein the manhole is located interiorly of a guardrail located on the upper tank portion.

8. The water tank as claimed in claim 1, wherein a door provides access to an interior of the pilaster, the door being secured against unintended entry.

9. The water tank as claimed in claim 1, wherein the opening through the upper tank portion is eccentrically positioned in the upper tank portion.

* * * * *